United States Patent [19]

Hässler et al.

[11] 4,147,909

[45] Apr. 3, 1979

[54] SINTERED COMPOSITE MATERIAL AS CONTACT MATERIAL FOR MEDIUM-VOLTAGE VACUUM POWER CIRCUIT BREAKERS

[75] Inventors: Heinrich Hässler, Wendelstein; Horst Kippenberg, Nüremberg, both of Fed. Rep. of Germany

[73] Assignee: Siemens Aktiengesellschaft, Munich, Fed. Rep. of Germany

[21] Appl. No.: 787,005

[22] Filed: Apr. 13, 1977

[30] Foreign Application Priority Data

May 3, 1976 [DE] Fed. Rep. of Germany ..... 2619459

[51] Int. Cl.$^2$ ..... H01H 1/02

[52] U.S. Cl. ..... 200/265

[58] Field of Search ..... 200/262, 263, 264, 265, 200/266, 270

[56] References Cited

U.S. PATENT DOCUMENTS

| | | | |
|---|---|---|---|
| 2,362,007 | 11/1944 | Hensel | 200/265 |
| 2,486,341 | 10/1949 | Stumbock | 200/265 |
| 2,504,906 | 4/1950 | Tremblay | 200/265 |
| 2,760,256 | 8/1956 | Richardson | 200/265 |
| 2,760,257 | 8/1956 | Richardson | 200/265 |
| 2,900,476 | 8/1957 | Reece | 200/265 |
| 3,014,104 | 12/1961 | Cobine | 200/265 |
| 3,143,626 | 8/1964 | Schreiner | 200/265 |
| 3,590,197 | 6/1971 | Wesoloski | 200/265 |
| 4,032,301 | 6/1977 | Hassler | 200/265 |
| 4,048,117 | 9/1977 | Emmerich | 200/265 |

*Primary Examiner*—Ro E. Hart

*Attorney, Agent, or Firm*—Kenyon & Kenyon, Reilly, Carr & Chapin

[57] ABSTRACT

The invention relates to a sintered composite material as the contact material for medium-voltage vacuum power circuit breakers, particularly in the switching voltage range from 7.2 kV to 36 kV. The contact material is comprised of a sintered composite of a burn-off-resistant metal component such as iron, cobalt, chromium, nickel, zirconium or alloys or mixtures of these metals, and a component which lowers the breaking current. As the breaking current-lowering component are provided metals, compounds or alloys of metals having a boiling point above 2400° C. such as, for example, tin, chromium carbide ($Cr_3C_2$) or copper zirconide ($ZrCu_4$, $ZrCu_3$).

6 Claims, No Drawings

SINTERED COMPOSITE MATERIAL AS CONTACT MATERIAL FOR MEDIUM-VOLTAGE VACUUM POWER CIRCUIT BREAKERS

BACKGROUND OF THE INVENTION

The invention relates to a sintered composite material as the contact material for medium-voltage vacuum power circuit breakers, particularly in the switching voltage range from 7.2 kV to 36 kV, consisting of a burn-off-resistant metal component having a melting temperature in the range between the melting temperature of copper (1083° C.) and 2000° C., for example, iron, cobalt, chromium, nickel, zirconium or alloys or mixtures of these metals.

The contact materials for medium-voltage vacuum power circuit breakers must meet stringent requirements as to current interrupting capacity (currents of at least 8 kA) and burnoff resistance (more than 10,000 switching cycles at nominal current). In order to assure the required interrupting power (nominal voltage times short-circuit current), the participating material components must have melting points below 2000° C., since metals with higher melting points have an increasing tendency toward secondary electron emission, which unduly limits the switching capacity (power interruption). In order to ensure the desired switching frequency, it is known to use as the burnoff-resistant components metals with a melting point above the melting temperature of copper (1083° C.). In order to avoid refiring of the switching tube after the zero current crossing when the voltage reappears, it is necessary, as is well known, that the metal vapors produced in the switching arc are condensed sufficiently rapidly. The metals used heretofore for lowering the breaking currents such as, for instance, bismuth, tellurium, selenium, manganese, lead and zinc, are not suited for vacuum switches of the order of magnitude above-mentioned.

SUMMARY OF THE INVENTION

It is an object of the invention to describe a contact material for medium-voltage vacuum power circuit breakers, with which the breaking currents in such circuit breakers and the accompanying overvoltages can be kept below four times the magnitude of the nominal voltages.

According to the invention, this and other objects are solved by providing as the breaking current-lowering components of the contact material metals, compounds or alloys of metals with a boiling point above 2400° C. Particularly well suited components are tin (Sn), chromium carbide ($Cr_3C_2$) and copper zirconides ($ZrCu_4$, $ZrCu_3$).

A minimum melting point for the breaking current-lowering component need not be considered; however, if copper (Cu) is used in the contact material, no appreciable formation of solid solution with copper must occur, as otherwise, the breaking current-lowering effect is weakened.

It was surprising that metals, compounds or alloys of metals with a boiling point above 2400° C. are suited as breaking current-lowering components, in contrast to the heretofore used components for lowering the breaking currents such as, for instance, bismuth, tellurium, selenium, manganese, lead or zinc having a substantially lower boiling point.

A particular advantage of this invention is that the breaking current-lowering effect of the components used according to the invention is so substantial that the most frequent breaking current is at least about 15% below the corresponding value of CrCu50.

DESCRIPTION OF THE PREFERRED EMBODIMENTS

EXAMPLE 1

From a metal powder mixture which contains 70 mass percent Cr, 20 mass percent Co and 10 mass percent Sn, a molding is prepared with a pressure of 5 tons/cm$^2$ and is subsequently sintered for an hour in vacuum at a temperature of 1600° C. After the sintering operation, a low-porosity contact blank is obtained, the residual pore content of which is less than 2% and the most frequent breaking current of which is about 50% lower than that of CrCu50.

EXAMPLE 2

A powder mixture of 70 mass percent chromium carbide ($Cr_3C_2$) and 30 mass percent Cr-powder is poured into a graphite mold and sintered at a temperature of 1200° C. in vacuum for one hour. After the sintering operation, a porous skeleton with about 50% by volume of pores is obtained. In a second operation, the chromium-carbide skeleton is impregnated with predegassed copper in a vacuum at a temperature of 1150° C. The composite material produced has a breaking current, the most frequent value of which is about 30% lower than that of CrCu50.

EXAMPLE 3

A mixture of 45 mass percent chromium powder, 45 mass percent copper powder and 10 mass percent zirconium powder are mixed and subsequently pressed at a pressure of 3 tons/cm$^2$. All powders have a grain size of less than 70 $\mu$m. The powder blank is subsequently sintered in a vacuum at a temperature of 1250° C. After the sintering operation, a low-porosity contact blank is obtained, the most frequent breaking current of which is about 15% lower than that of CrCu50.

What is claimed is:

1. In a material for use as a medium-voltage vacuum power circuit breaker in the switching voltage range of from about 7.2 kV to 36 kV, comprising a sintered composite of a burnoff-resistant metal component having a melting temperature in the range of from about 1083° C. to about 2000° C., and a breaking current-lowering component, the improvement comprising utilizing chromium carbide as said breaking current-lowering component.

2. The sintered composite material according to claim 1 wherein said burnoff-resistant metal component is selected from the group consisting of iron, cobalt, chromium, nickel, zirconium, and alloys or mixtures thereof.

3. In a material for use as a medium-voltage vacuum power circuit breaker in the switching voltage range of from about 7.2 kV to 36 kV, comprising a sintered composite of a burnoff-resistant metal component having a melting temperature in the range of from about 1083° C. to about 2000° C., and a breaking current-lowering component, the improvement comprising utilizing copper zirconide as said breaking current-lowering component.

4. In a material for use as a medium-voltage vacuum power circuit breaker in the switching voltage range of from about 7.2 kV to 36 kV, comprising a sintered composite of a burnoff-resistant metal component having a melting temperature in the range of from about 1083° to about 2000° C., and a breaking current-lowering component, the improvement comprising a utilizing tin as said breaking current-lowering component.

5. The sintered composite material according to claim 3 wherein said burnoff-resistant metal component is selected from the group consisting of iron, cobalt, chromium, nickel, zirconium, and alloys or mixtures thereof.

6. The sintered composite material according to claim 4 wherein said burnoff-resistant metal component is selected from the group consisting of iron, cobalt, chromium, nickel, zirconium, and alloys or mixtures thereof.

* * * * *